United States Patent [19]

Riggins et al.

[11] Patent Number: 4,672,259

[45] Date of Patent: Jun. 9, 1987

[54] POWER SPARK GAP ASSEMBLY FOR HIGH CURRENT CONDUCTION WITH IMPROVED SPARKOVER LEVEL CONTROL

[75] Inventors: Oral L. Riggins, Madison Township, Daviess County; Thomas L. Dyer, Jr., Bloomington, both of Ind.

[73] Assignee: Westinghouse Electric Corp., Pittsburgh, Pa.

[21] Appl. No.: 790,696

[22] Filed: Oct. 23, 1985

[51] Int. Cl.[4] ..... H01J 17/04

[52] U.S. Cl. ..... 313/231.11; 313/325; 313/631

[58] Field of Search ..... 313/231.11, 325, 631, 313/632, 633

[56] References Cited

U.S. PATENT DOCUMENTS 3,230,410 1/1966 Hafkemeyer, Jr. et al. ... 313/631 X 4,277,719 7/1981 Riggins ..... 313/325

*Primary Examiner*—David K. Moore

*Assistant Examiner*—Kenneth A. Wieder

*Attorney, Agent, or Firm*—G. H. Telfer

[57] ABSTRACT

A power spark gap for protection of electrical equipment against overvoltages and having high current handling capacity is provided consisting of two carbon electrodes each of a hemispherical configuration disposed within a porcelain housing and with vent holes in the electrodes permitting arc transfer to an inner sleeve of durable conductive material.

3 Claims, 4 Drawing Figures

POWER SPARK GAP ASSEMBLY FOR HIGH CURRENT CONDUCTION WITH IMPROVED SPARKOVER LEVEL CONTROL

BACKGROUND AND SUMMARY OF THE INVENTION

This invention relates generally to spark gaps for use as voltage limiters or surge suppressors and particularly to power spark gaps for conduction of thousands of amperes of current in response to high voltages such as 100 kilovolts or more.

Power gaps of the general type to which the present invention relates have been previously used, for example, to protect series capacitors from overvoltages due to faults or lightning surges on transmission lines. In such applications, it is highly desirable to have a compact and economical device that is capable of consistent performance upon repeated operation over a long period of time. One form of device presently used has a relatively large, well ventilated, metal cabinet enclosing spherical gap electrodes. These are generally bulky and expensive and also may deteriorate in performance upon repeated firings.

Another form of device that has been used is that including a relatively small porcelain housing enclosing a spark gap of carbon electrodes in an arrangement that provides a toroidal to a planar gap interface. Such a device is that described in Riggins U.S. Pat. No. 4,277,719, July 7, 1981 which is herein incorporated by reference for its general description of such devices. Such a device operates quite well in terms of consistency of sparkover level and achieves such performance in a relatively compact economical assembly. One respect in which it is desirable to improve the performance of such devices is the consistency of the sparkover level upon different polarities of voltage as it is the case that the gap must fire regardless of the polarity of the AC voltage on its electrodes. Spark gaps of the type described in the above-mentioned patent may exhibit a variation in sparkover level for opposite polarities of up to about 18 percent. Also, such devices exhibit less change of sparkover level for a change in electrode spacing than is sometimes desirable.

In accordance with the present invention a new design of power spark gap device is provided that incorporates electrodes of a hollow, hemispherical configuration inside a porcelain enclosure. This enables a considerably higher sparkover-to-spacing ratio and an improved impulse polarity response than prior designs. Incorporated into the electrodes is a unique arcing tip support that provides a short low resistance path, via vent holes through the carbon electrode bodies, for the arc plasma to communicate with higher conductive sleeves within the electrode bodies. This prevents the arc from migrating to undesired areas such as the copper support of the electrodes. The vents through the electrode bodies also provide pressure relief for the expanding arc gases via the hollow support tube supporting one of the electrodes. This design provides a sparkover versus spacing curve that is almost identical to laboratory sphere gaps of comparable size and permits an increase of approximately 150% in the voltage rating of an equivalent existing design with close similarity of positive and negative polarities.

The above mentioned and other aspects of the invention will be better understood with reference to the following description and accompanying drawing.

DESCRIPTION OF THE PREFERRED EMBODIMENTS

Figure 1:
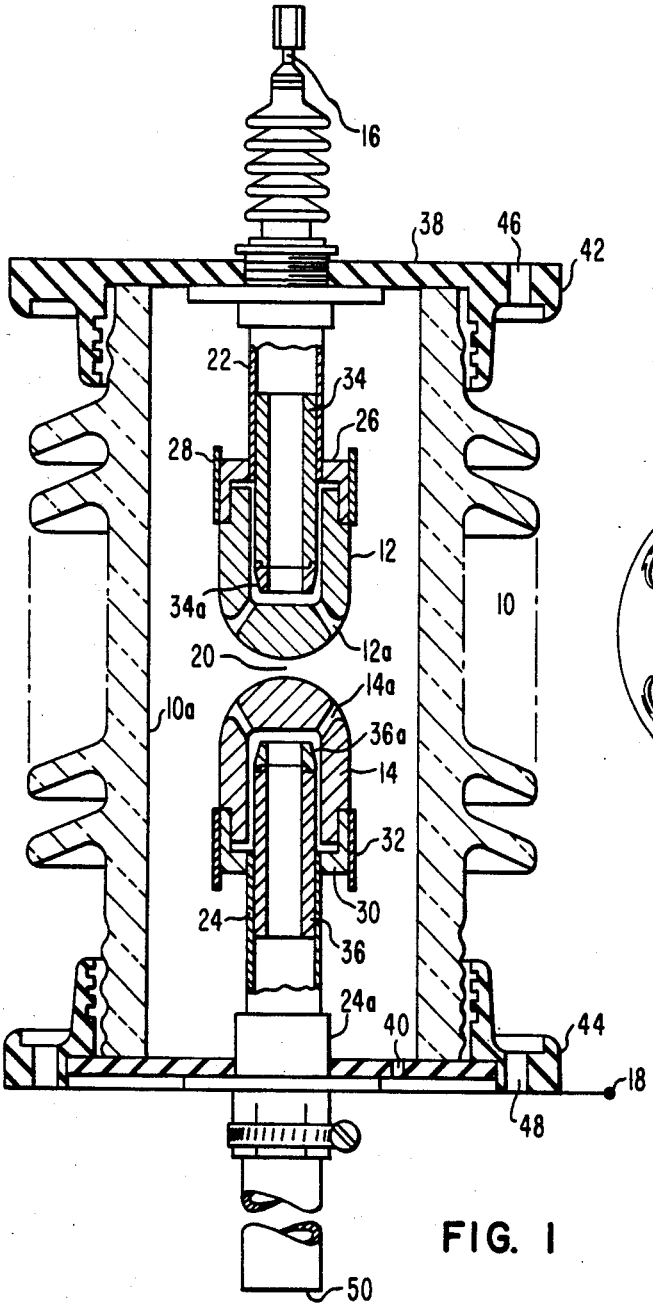
FIG. 1 is a cross-sectional view of a power spark gap assembly in accordance with an embodiment of the present invention.

Referring to FIG. 1, there is shown a power spark gap assembly in accordance with an embodiment of the present invention. The device comprises a tubular housing 10 of porcelain or the like in which are located first and second electrodes 12 and 14 that are electrically arranged respectively in association with first and second external terminals 16 and 18.

The external terminals 16 and 18 are merely shown schematically. The electrodes 12 and 14 are of an electrode material such as carbon physically configured as substantially hemispherical bodies with their substantially hemispherical exterior surfaces facing each other across a gap 20. Each of the electrodes 12 and 14 is substantially hollow with a substantially cylindrical bore. As shown, the electrode bodies 12 and 14 may have cylindrical extensions from their purely hemispherical ends but are still regarded as substantially hemispherical.

Figure 2:
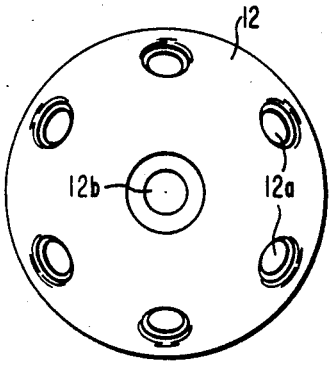
FIG. 2 is an end view of one of the electrodes of FIG. 1.

FIG. 2 illustrates an end view of the exterior surface of one of the electrodes 12 which may be and preferably are substantially identical and centered, and thus symmetrically arranged, within the housing 10.

Electrode 12 has vent holes or apertures **12*a* extending from the outer to the inner surfaces of the hollow hemispherical electrode body. Likewise, electrode 14 has vent holes or apertures 14*a*. The vent holes 12*a* and 14*a* serve to direct an arc, after being initially struck between the electrodes 12 and 14 themselves and then building to a high current level, into the interior of the electrodes and the inner sleeves 34 and 36**, described below.

The housing 10 preferably has a liner or coating **10*a* on its entire interior surface 10 of a material such as polytetrafluoroethylene for reduction of conductive paths that might be formed by material vaporized from the electrodes 12 and 14** and deposited on the housing wall during operation.

An electrode support assembly is provided for each of the electrodes 12 and 14 that includes first and second conductive support tubes 22 and 24 respectively in conductive communication with one electrode 12 and 14 and one external terminal 16 and 18. Copper is a preferred material for the tubes 22 and 24. Supported on the exterior of the copper tube 22 is a conductive flange member 26 that is conductively bonded to the tube 22. The flange member 26 in turn supports and is conductively bonded to the electrode body 12. On the radial exterior of the flange member 26 is an insulative sleeve 28, such as of polytetrafluoroethylene. Sleeve 28 also extends over, though spaced from, part of the tube 22. Likewise, electrode 14 and tube 24 are associated with a second flange 30 and a second sleeve 32. Sleeves 28 and 32 serve as arc shields minimizing the possibility of arcing between the flanges 26 and 30 and copper tubes 22 and 24 of the support assemblies.

Inner sleeves 34 and 36 are respectively joined to each of the copper tubes 22 and 24 and are of a highly conductive durable material. The sleeves 34 and 36 are joined to the inner surface of the respective support tubes 22 and 24. The electrodes 12 and 14 themselves are chosen of a more durable conductive material such as carbon but the current they carry is transferred to a higher conductivity, less durable, material such as copper or aluminum. The inner sleeves 34 and 36 extend well within, though with a small spacing from, the hollow, hemispherical electrodes 12 and 14 and thus confine the arc more reliably. The ends 34*a* and 36*a* of each sleeve are preferably of a more higher durability material, such as a silver tungsten alloy, though somewhat less conductive than the major portion of the sleeves 34 and 36 and the support tubes 22 and 24.

The support assembly, including support tubes 22 and 24, flanges 26 and 30, insulative sleeves 28 and 32, and inner conductive sleeves 34 and 36, for each of the electrodes 12 and 14 is substantially similar to that of the above-mentioned patent for the lower electrode thereof. However, in accordance with the present invention each of the electrodes 12 and 14 is provided with such a support assembly and the electrode bodies themselves are configured in a hemispherical rather than a toroidal configuration.

Upper and lower conductive closure plates 38 and 40 are provided at the ends of the substantially cylindrical housing 10. Flanged elements 42 and 44 serve to unite the closure plates 38 and 40 and the housing 10 as well as provide means, such as is indicated by the fastener apertures 46 and 48, for mounting the device on a further support structure.

The lower one 14 of the two electrodes has its support sleeve 24 provided with an extension 24*a* passing through the lower closure plate 40 and communicating to a discharge port 50. This provides a discharge for expanding arc gases.

Figure 3:
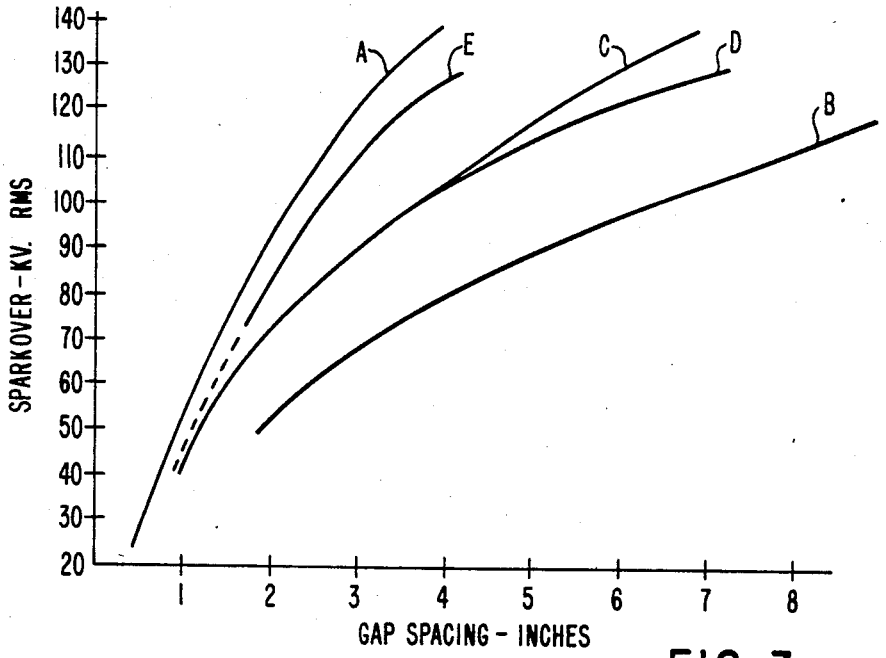
FIG. 3 is a set of curves showing performance data for devices in accordance with the present invention in contrast with others.

FIG. 3 illustrates performance of a device in accordance with the present invention in contrast with other configurations. The data plotted is that for the sparkover level in kilovolts RMS in relation to gap spacing in inches with all values corrected to standard conditions of 20° C. and 760 mm mercury. Desirable data for a power spark gap device would show a relatively low rate of change of gap spacing for different sparkover levels or, stated differently, would exhibit a relatively large change in sparkover level for a given change in gap spacing.

Curve A shows the results for spherical gaps of a diameter of about 12.5 cm in a large ventilated housing. Curve A represents very good performance but is not for a compact device that is economical to use in field service.

Curve B represents data for a power gap of the type illustrated and described in the above-mentioned patent which has relatively little change in sparkover level with increasing gap spacing. The results as shown in curve B do not disqualify the device from use in many applications but are not as desirable as those of curve A. That is, for a given size of a device of that design there is a more limited range of sparkover levels available by adjusting the gap spacing.

Curve C shows somewhat improved results for a device in accordance with the present invention with upper and lower hemispherical electrodes but with no venting. Also, the electrodes were not centered within the porcelain housing.

Curve D shows a device which is the same as that used for curve C but with the addition of vent holes in only the lower electrode. As these tests show, the provision of such vent holes actually diminishes performance rather than improves it.

Curve E is for a device in accordance with the present invention in which the electrodes are matched hemispheres with venting in both electrodes but in which the hemispheres are located with the gap not centered within the porcelain housing. The data of curve E is markedly superior to that of curves B, C or D.

For a device in accordance with the invention with double hemispherical electrodes with vent holes in both electrodes and with centering within the porcelain housing, the results substantially match those of the spherical gap in a large ventilated housing illustrated in curve A. Therefore, the present invention improves over that of the above-mentioned patent by obtaining results that can in the preferred form of the invention substantially match those of the large spherical gap arrangement.

From the data presented in curves E and A it is seen that centering the spark gap 20 in the porcelain housing 10 is preferred although useful characteristics can also be obtained with an uncentered gap. As an example, a device has been made in accordance with FIG. 1 in which the porcelain housing 10 was about 22 inches in length and the gap 20 was about 1 inch. A centered gap, within about 1 inch of true center, yields results substantially as shown in curve A.

Additional tests were conducted for determining sparkover levels of a device in accordance with the present invention where both the upper and lower electrodes are hemispheres with vent holes only in the lower electrode and the electrodes are centered within the housing. In one set of tests the upper electrode was made positive to ground dwelling and in another set of tests the upper electrode was made negative to ground. With the upper electrode positive to ground it was found that the average sparkover equaled 136.9 kv with an impulse ratio of 1.09. With the upper electrode negative to ground the results were an average sparkover level of 142.3 kv and an impulse ratio of 1.13. These results are highly favorable for their consistency whereas the device in accordance with the abovementioned patent exhibited variations depending on polarity of up to about 18%.

Figure 4:
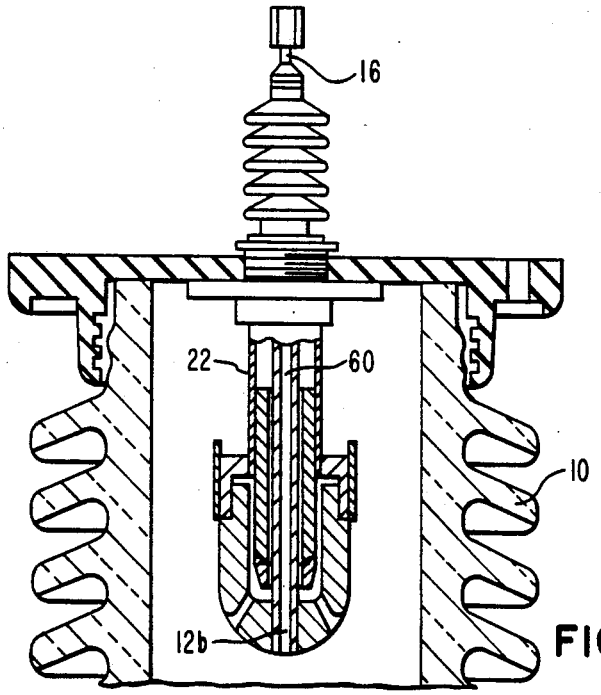
FIG. 4 is a partial cross-sectional view of a power spark gap assembly in accordance with modified embodiment of the invention.

Another variation in accordance with the invention is that illustrated in FIG. 4 wherein a device otherwise substantially in accordance with FIG. 1 is provided with the addition of a top electrode trigger device 60 for force firing the gap 20.

The triggering device 60 is simply an insulated conductor extending from the top terminal 16 axially through the sleeves of the top electrode support assembly. Top electrode 12 has a central aperture 12*b* in which an exposed extremity of the conductor 60 is located. This permits an external voltage signal to fire (spark) between upper electrode 12 and a metal conductor (similar to electrodes in automobile sparkplugs). This spark ionizes the gas in the high stress area between electrodes 12 and 14 which will cause the main discharge current to flow.

It is therefore seen that in accordance with the present invention improvements have been made in power spark gaps of a compact configuration that closely matches the performance of large spherical gaps in ventilated housings thus providing an improved impulse ratio and permits an increase of approximately 150% in the voltage rating of an equivalent existing design. Another area of improvement is that impulse sparkover response relative to positive and negative polarities is approximately the same.

What we claim is:

1. A power spark gap for conduction of high currents upon occurrence of an overvoltage such as 100 kilovolts or more comprising:

a pair of electrodes, each of said pair of electrodes comprising a substantially hemispherical hollow body of carbon electrode material and arranged in relation to the other of said electrodes in a substantially summetrical arrangement with central areas of the exterior of said substantially hemispherical bodies directly facing each other across a gap;

said pair of electrodes each being supported on an electrode support assembly including an inner sleeve of more highly conductive material than said electrode material located with an extremity within said body proximate the inner surface of said body, each of said pair of electrodes having vent holes through said hemispherical body; said inner sleeve having the capability of conducting higher currents than said body and serving as means for receiving through said vent holes, and substantially confining, a high current arc that is initiated between said hemispherical bodies of said pair of electrodes;

said hemispherical bodies of carbon electrode material each comprising a carbon material having higher durability to arcs than the material of said inner sleeves and each of said sleeves having a portion of higher durability at said extremity thereof than the remainder of said sleeve.

2. A power spark gap is accordance with claim 1 wherein:

said pair of electrodes are in an insulating enclosure with said inner sleeves having conductive terminal means extending therefrom, at least one of said inner sleeves having a gas blast arc extinction path therethrough communicating to the exterior of said enclosure.

3. A power spark gap in accordance with claim 1 wherein:

a means for triggering conduction in said gap is provided in close association with one of said electrodes.

* * * * *